United States Patent [19]

Anderson

[11] 4,253,592

[45] Mar. 3, 1981

[54] BELT LOOP ANCHORING DEVICE FOR A GUN HOLSTER

[76] Inventor: Warren F. Anderson, 11215 Hatteras St., North Hollywood, Calif. 91601

[21] Appl. No.: 32,153

[22] Filed: Apr. 23, 1979

[51] Int. Cl.[3] ..... B41C 33/02

[52] U.S. Cl. ..... 224/198; 224/192; 224/911

[58] Field of Search ..... 224/191, 192, 195, 197, 224/198, 253, 256, 904, 911, 912, 914

[56] References Cited

U.S. PATENT DOCUMENTS

| | | | |
|---|---|---|---|
| 2,387,900 | 10/1945 | Hartwell | 224/197 |
| 2,410,640 | 11/1946 | Engle | 224/198 |
| 2,504,369 | 4/1950 | Adair | 224/253 |
| 2,990,987 | 7/1961 | Handler et al. | 224/198 |
| 3,117,708 | 1/1964 | Goldman | 224/198 |
| 3,168,972 | 2/1965 | Parlante et al. | 224/911 X |
| 3,610,487 | 10/1971 | Campos | 224/198 |

*Primary Examiner*—Steven M. Pollard
*Attorney, Agent, or Firm*—Jack C. Munro

[57] ABSTRACT

A belt loop for a gun holster made from a thin strip of material which is formed into a loop which is to swivel upon the pistol supporting housing of a holster. The belt being worn by the wearer is to pass through the loop. The ends of the loop are detachable connected together so as to permit attachment and detachment with the belt. This device is affixed to the exterior of a gun holster in a manner to permit easy accessibility to a gun carried in a holster by either the right or left hand.

3 Claims, 4 Drawing Figures

Fig. 1
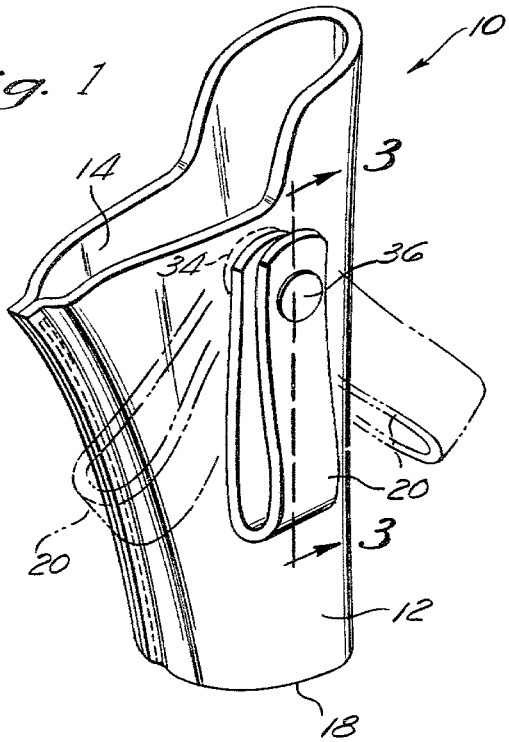
Fig. 3
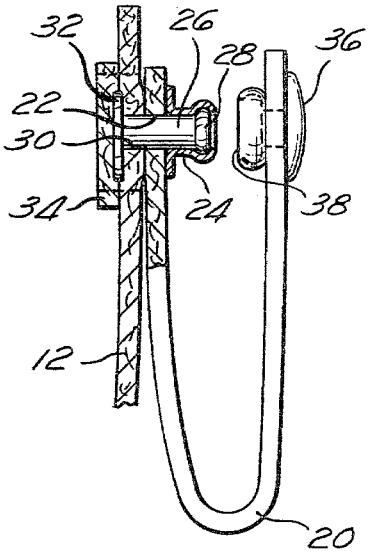
Fig. 2
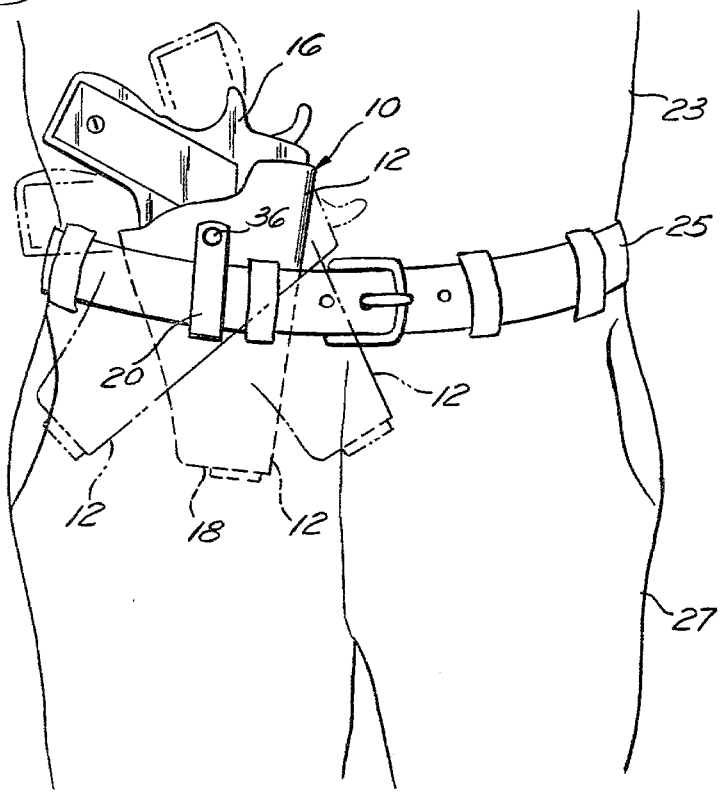
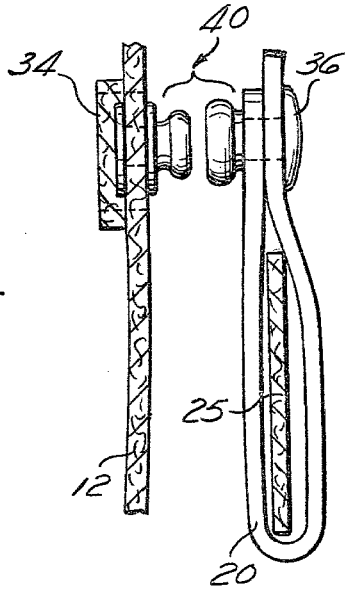
Fig. 4

BELT LOOP ANCHORING DEVICE FOR A GUN HOLSTER

BACKGROUND OF THE INVENTION

The field of this invention relates to a holster for a pistol inasmuch as a holster for a pistol is a desirable arrangement, but the holster could be used to support other objects to be carried upon a belt around the wearers waist and located between the belt and the person's body.

The use of a holster to support a pistol to facilitate its carrying on a persons body is well known. Most holsters are adapted to support the pistol in a visible location upon a person's body. However, there have been used holsters which are to be worn inside of a coat in an attempt to conceal the carrying of the pistol. At times it is desirable to conceal the fact that a pistol is being carried. This concealment is normally desirable by plain clothed law enforcement officers. However, a pistol is inherently bulky and will certainly produce an abnormal bulge within a coat which is worn over the pistol. This bulge is readily noticeable by even an untrained observer.

One function of a pistol holster is to locate the pistol in a position so as to facilitate quick drawing of the pistol. The commonly used pistol holder is to be attached directly upon the belt located about the waist area of the wearer with the pistol holster being positioned in a pre-determined manner by its manufacturer, causing it to be readily accessible to only one hand of the person. This is desirable by certain individuals, but other individuals would prefer another position such as being inclined in some manner with respect to the belt. A conventional prior art holster cannot be adjusted. Therefore, a particular wearer may be forced to use a holster which positions the pistol in an awkward position. This position may make the draw of the pistol substantially slower. Possibly in an emergency situation the drawing of the pistol in the shortest possible time by either hand may prove the difference between life and death.

Prior art holsters have employed some means to fixedly secure the holster to the belt of the wearer. Such common means are by the use of a spring clip, or as previously discussed, by direct attachment to the belt.

SUMMARY OF THE INVENTION

The pistol holster for this invention takes the form of a leather (or other similar material) housing within which is to be located the pistol. On the exterior surface of the housing is mounted a looped strap. The ends of the looped strap are connected together through a conventional snap or a stud or rivet, swiveled on the housing. The trouser supporting belt of the wearer is to be passed through the loop of the strap with the housing of the holstter located between the belt and the person's body. This means that the holstered pistol is pressed inwardly by the pressure of the belt into the person's body thereby facilitating concealment of the pistol. Also, the holster can be located at any inclined position with respect to the belt, so therefore, the holster can accomodate different individuals desires as to the location of the pistol to facilitate quick-draw thereof by either right or left hand. The holster can be located at any position along the longitudinal length of the belt and adjusted by the individual to facilitate comfort and ease of rapid drawing of a pistol.

One objective of this invention is that once the position of the holster with respect to the person's body has been established, that position will be maintained until the individual desires to change the position. This is due to the fact that the holster is tightly pressed between the belt and the person's body.

Another objective of this invention is that even with the holster holding a substantially large sized pistol, it is difficult for another person to visually ascertain carrying of the pistol if the pistol is located beneath a coat or jacket or outside garment such as a sport shirt.

Another advantage of this invention is that it is non-complex in construction and can be manufactured and sold at moderate prices in a highly competitive market.

BRIEF DESCRIPTION OF THE DRAWINGS

FIG. 1 is an isometric view of a pistol holster for this invention shown disconnected from a pistol;

FIG. 2 is a front view of an individual using the pistol holster of this invention showing the cooperation with the pistol and the pistol holster being mounted in conjunction with the wearer's body;

FIG. 3 is a cross-sectional view taken along line 3—3 of FIG. 1 showing in more detail the connection of the loop to the housing of the pistol holster; and FIG. 4 is a view similar to FIG. 3 but with a different connection between the housing and the belt loops to permit detachment of the loop from the housing.

DETAILED DESCRIPTION OF THE SHOWN EMBODIMENT

Referring particularly to the drawing there is shown a pistol holster 10 attached to this invention which is comprised mainly of an enclosed case or housing 12. Housing 12 includes an internal chamber or compartment 14 within which is to be supported a pistol 16. The housing 12 could be constructed of various sheet materials. However, it is desirable for the housing 12 to have a certain amount of "give" so as to enhance comfort to the individual. A desirable type of material would be leather.

Attached to the exterior surface of the housing 12 is a strap 20 also normally constructed of leather. The strap 20 is folded over on itself to form a loop and the belt 25 worn about the waist of the individual 23 is to be conducted through this loop. The inner end of the strap 20 includes a hole 22. Located about the hole 22 and fixedly attached to the strap 20 is a sleeve 24. A rivet 26 which has a flared outer end 28 extends through the sleeve 24 and is permanently engaged with the sleeve 24 due to the flared end 28. The rivet 26 also passes through a hole 30 formed within the housing 12. The structure of FIG. 3 shows only one of several known devices of attaching the structure of this invention to a gun holster.

Adjacent the inside surface of the housing 12 and integrally formed with rivet 26 is an enlarged base 32. Base 32 is covered by means of leather cover 34 for protection of the exterior finish of a pistol. Other pistol finish protection structures could be employed instead, such as a lining on the inside surface of the housing 12. It is to be understood from the foregoing that strap 20 is readily rotatable or pivotable with respect to the housing 12 by means of the interconnection between the rivet 26 and the sleeve 24 or other swivelling methods.

The outer end of the strap 20 includes a cap 36. The cap 36 includes an internal opening 38. The exterior surface of the sleeve 24 is to be "snapable" within the opening 38 to securely connect together the ends of the strap 20. It is to be understood that the ends of the strap 20 can be readily released from each other by merely manually disengaging the cap 36 from the sleeve 24.

The use of the holster 10 with this invention attached is depicted in FIG. 2 wherein the strap 20 is located about the belt 25 of the wearer and the housing 12 is located between the body 23 of the wearer and the inside surface of the belt 25. It can be readily observed that the belt 25 forces the housing 12 and the pistol 16 into tight engagement with the body 23. Actually, the housing 12 and the pistol 16 are somewhat pressed into the body 23. Also, the trousers 27 of the wearer function to further press the housing into the body 23. However, it is to be understood that the housing may be located either inside of a belt only, or both belt and trousers. This pressing into the body functions to conceal the carrying of the pistol 16 assuming that the individual 23 has a coat or jacket or any outside clothing extending below belt 25 of a person 23.

As shown within FIG. 2, the housing 12 can be located at various angular positions with respect to the belt 25. This means that the pistol 16 is similary inclined and can be located and maintained in the established inclined position. A particular inclined position may be desirable for one individual where another inclined position will be desirable for another individual. As a result, the holster 10 for this invention can accommodate any particular position an individual may desire in order to facilitate quick drawing of pistol 16, with right hand or left hand.

Referring to FIG. 4, there is shown a different type of connection device 40 which permanently interconnects the free ends of the loop 20. However, the connection device 40 permits detachment of loop 20 from housing 12. This is for the purpose of quick removal of pistol and holster not requiring any manipulation of the belt 25.

Such quick removal is required in certain instances, such as in court rooms, social events, and the like.

It is further to be understood that the housing 12 can be located at any position along the belt 25 so that the holster 10 can be mounted in the front of the individual or can be located in the back of the individual. This invention can be used with various holster constructions and relates to the anchoring structures for the various holsters including knife sheaths, magazine pouches, ammunition carriers, etc.

What is claimed is:

1. In combination with the body of a human being, said body having a waist area, a belt worn about said waist area, said belt to secure a pair of trousers onto said body, a pistol hoster to be located between said body and said belt, said pistol holster comprising:

a thin-walled housing having an internal chamber adapted to support an object to be carried, said housing having an exterior surface and an inner surface, said inner surface to be against said body, said exterior surface to be against said belt;

a strip of material having a first end and second end formed into a loop, said belt to pass through said loop, said exterior surface of said housing to be against said strip of material, said first end being connected by a swivel connection to said exterior surface of said housing, whereby said strip of material is capable of being located anywhere along said belt and also said housing is capable of assuming a plurality of different inclined positions in respect to said belt to accommodate either the right or left hand, the desired inclined position being established by the individual and maintained due to the inherent wedging pressure between said body and said belt.

2. The combination as defined in claim 1 wherein:

said second end of said strip of material detachably connected to said first end by connection means.

3. The combination as defined in claim 2 wherein:

said connection means comprising a snap, said snap including means to permit detachment of said strip of material from said housing.

* * * * *